United States Patent [19]

Magadini

[11] Patent Number: 4,704,830

[45] Date of Patent: Nov. 10, 1987

[54] INCREASING THE LOAD CARRYING CAPACITY OF BEAMS

[76] Inventor: Charles R. Magadini, 6024 No. 20th St., Phoenix, Ariz. 85016

[21] Appl. No.: 826,831

[22] Filed: Feb. 6, 1986

[51] Int. Cl.[4] ..... E04C 3/10

[52] U.S. Cl. ..... 52/226; 52/729; 52/741; 52/647

[58] Field of Search ..... 52/225, 226, 223 R, 52/729, 741, 647

[56] References Cited

U.S. PATENT DOCUMENTS

| | | | |
|---|---|---|---|
| 2,822,068 | 2/1958 | Hendrix | 52/226 |
| 2,856,644 | 10/1958 | Dunham | 52/226 |
| 3,341,995 | 9/1967 | Docken | 52/226 |
| 3,347,242 | 10/1967 | Barker | 52/226 X |
| 3,427,773 | 2/1969 | Kandall | 52/225 |

FOREIGN PATENT DOCUMENTS

| | | | |
|---|---|---|---|
| 51064 | 1/1911 | Switzerland | 52/226 |

*Primary Examiner*—Carl D. Friedman

*Assistant Examiner*—Naoko N. Slack

*Attorney, Agent, or Firm*—Laurence R. Brown

[57] ABSTRACT

This invention simplifies reworking of structures such as buildings having load bearing beam girders embedded therein with limited access thereto for increasing the load bearing capacity of the girders. It also permits the increase of load bearing capacity of steel I-beam girders without welding therefore eliminating the fire danger of welding strengthening members thereto. The rework of the in-situ embedded beam is accomplished with minimal building damage. Thus, the building need be reworked only to gain access to two ends of the I-beam girders and a mid-region load bearing position on the lower flange of the I-beam. A flexible tension load bearing member such as a chain is then strung alongside the I-beam web portion end to end and hooked over the top flange. Thus existing pipes, ducts and wiring need not be disturbed. The mid-section of the chain is then attached in a load bearing capacity to the lower flange, preferably by a post tension controlling adjustable link controlling the chain tension.

17 Claims, 6 Drawing Figures

INCREASING THE LOAD CARRYING CAPACITY OF BEAMS

TECHNICAL FIELD

This invention relates to load bearing beam girders such as I-beams and more particularly it relates to methods of increasing the load bearing capacity of beams, particularly in-situ beams embedded in existing buildings and the like.

BACKGROUND ART

Significant problems are imposed in the reworking of building structures to increase their load bearing capacities. It is certainly desirable to do this with minimal modification to existing structures, and without requiring a significant amount of tearing down and rebuilding the former structure. Yet there has not been provided over the many years the need has existed satisfactory solutions to this type of rework.

Typically in the prior art, to increase the load bearing capacity of beam girders embedded in a building structure, the girders would have to be exposed by destruction of adjacent walls and other existing building structure. Then strengthening plates, trusses or braces would be added in critical locations. For steel I-beams these would be welded to the beam. The welding process itself in existing structures is a critical operation that sometimes imposes a fire hazard. Alternatively the girders would need be removed and replaced by substitute girders of higher load bearing capacity. This is not always feasible in the space and circumstances involved.

It is therefore an objective of this invention to provide an improved method of strengthening beams, particularly those beams in place as girders in existing structures.

DISCLOSURE OF THE INVENTION

The substantially non-destructive reworking of existing structures to increase the load bearing capacity of embedded beam girders is made possible by the method and beam structure afforded by this invention. Thus only limited access to the embedded beams to be reworked is required at two outer positions, preferably the ends of the beams and at one intermediate load bearing position. Therefore the walls, finish and associated building structure that need be destroyed or removed is minimal.

In a preferred embodiment, a steel I-beam is modified to carry a heavier load. Because of the I-beam construction with a web member from which extends upper and lower flanges, there is an access passageway from one end to the other between the flanges and adjacent the web. Through this passageway is threaded a flexible tension bearing longitudinal member such as a chain or cable (referred to hereinafter as chain). This chain is then attached in tension bearing capacity to the upper flange portion of the I-beam at each end, such as by means of hooks engaged over the ends of the upper flange. Preferably one such chain is used on each side of the web.

Thereafter, the chain is affixed to the lower flange at the access position in a load bearing capacity to share the load and increase the load bearing capacity of the beam. Preferably this is done at a load bearing metal plate below the beam and in load bearing contact with the lower flange to which both chains are affixed on their respective sides of the web in taut or tensioned condition. Very simply by means of adjustable tensioning means comprising a bolt and nut coupler member between the lower flange, or plate, and the chain, the tension in the chain can be adjusted to the desired load sharing proportion in the static condition of the beam. Furthermore the load between the two chains on opposite sides of the web may thus be simply balanced.

Thus, the invention provides a method by which a structure may be reworked to increase the load bearing capacity of its embedded I-beam girders without the necessity for welding or significant destruction of the existing structure. The beam structure itself is also an advance in the art to provide a simply modified standard I-beam with greater load bearing capacity. It may thus replace a larger or custom designed beam, and permit I-beams of smaller dimension and standard sizes to be used for higher load ratings than heretofore feasible. Schemes for increasing the load bearing capacity of I-beams known in the prior art are complex, expensive and not adaptable to embedded in-situ rework. Exemplary of such art is the U.S. Pat. No. 3,427,773 to C. Kandall, Feb. 18, 1969 wherein it was necessary to weld on various struts and mounts for adding a sliding bar support and a flexible cable array. This entire array located intermediate the ends of the I-beam is coupled to a plurality of intermediate cross members by means of welded on cross members distributed along the length of the beam. Such prior art structures could not be substituted for the methods and structures of this invention, particularly to strengthen the in-situ embedded I-beams of an existing building or the like.

BRIEF DESCRIPTION OF THE DRAWINGS

The advantages and improvements of this invention are better understood with reference to the accompanying drawings, wherein.

THE PREFERRED EMBODIMENT

Figure 1:
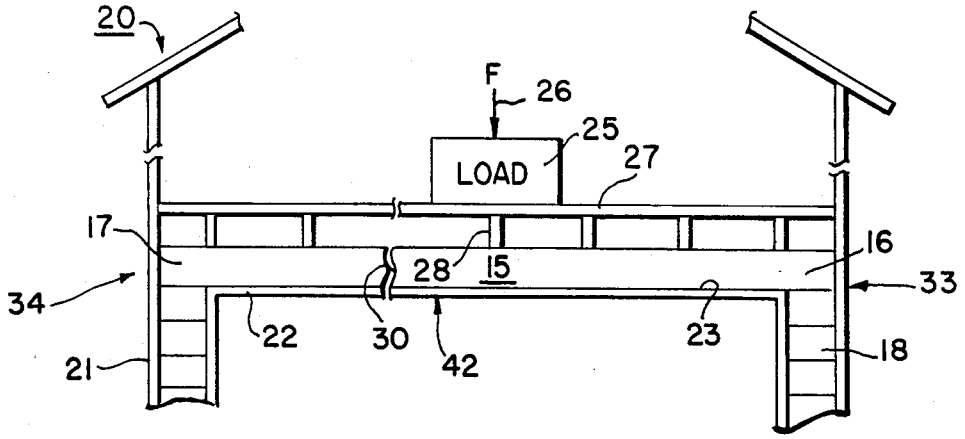
FIG. 1 is a line sketch, in side view section, of a segment of an existing structure, such as a building, in which there is an embedded I-beam girder with the requirement or reworking to increase its load bearing capacity.

In FIG. 1, an I-beam girder 15 is supported at its ends 16, 17 upon load bearing members, such as blocks 18 of the building 20 generally represented in fragmental form. The building has outer trim and finish covering and embedding the I-beam 15 at ends 16 and 17. Also inner trim and finish 22 covers and embeds the I-beam adjacent its lower flange 23. Typically the I-beam is loaded by load 25, exerting a downward force 26 on the floor 27 transmitted to the I-beam by way of cross beams 28, typically wooden planks or the like.

If the load 25 is to be increased, such as by moving in a larger and heavier machine, the limitation on such increase is the load bearing capacity of the I-beam. If the new load exceeds the load bearing capacity of the I-beam, then the building structure need be modified for access to the I-beam, and the I-beam need be replaced or modified to increase its load bearing capacity.

This presents a considerable problem of reconstruction cost and even feasibility in some cases, since conventionally in the prior art significant destruction of the existing structure need occur to obtain access to the I-beam 15. Even after that, conventional practices in increasing the load bearing capacity of the I-beam 15 would require the welding in place of strengthening struts and braces along substantially the entire length of the beam. Such welding is limited in practice by the fire hazard to the wooden beams 28 and other structural materials in the vicinity of the I-beam 15. This prevents extensive welding. Furthermore, there is no accessibility after welding to check out the integrity of the welds. Thus, increasing the load bearing capacity by this method is acceptable only in limited circumstances, and in many cases is not permissible.

Alternately, the beam may be removed and replaced with another. This requires even further description of the adjacent walls and finishings, to assure that all appendant loaded on structures such as beams 28 and all adjacent contacting surfaces are free enough to remove the existing I-beam and insert one of greater load bearing capacity. This includes precautions for bearing the load temporarily while replacement is being made. Also I-beams are made in standard sizes and when dimensisons are changed, greater problems are incurred. It is not generally feasible to custom design and I-beam with appropriate increased load bearing capacity to fit into the same place.

All of these problems are by-passed by the novel simplified structure and method of this invention for increasing the load bearing capacity of I-beam 15 with minimal destruction of the existing structure and with far less danger, manpower and time taken in the prior art.

Figure 2:
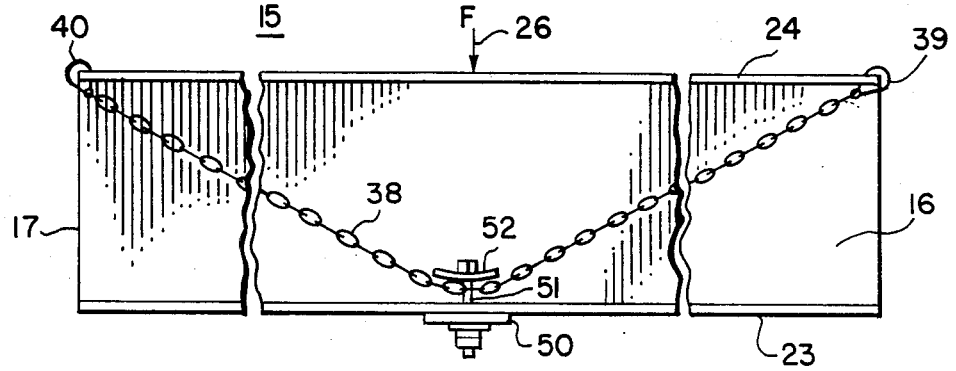
FIGS. 2, 3 and 4 are respectively side, top and end view sketches of an I-beam constructed in accordance with this invention to provide increased load bearing capacity, which might be, for example, a beam embedded in a structure such as shown in FIG. 1.
Figure 3:
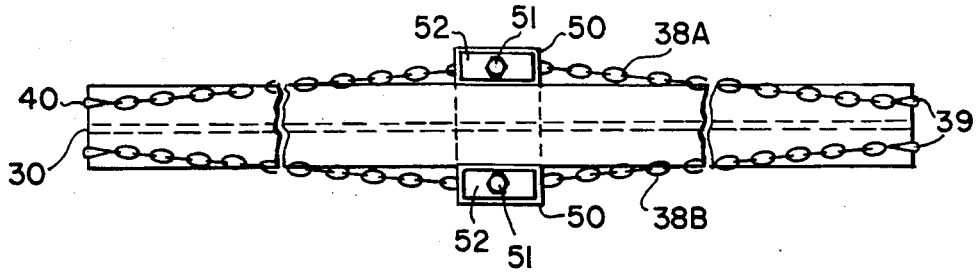
Figure 4:
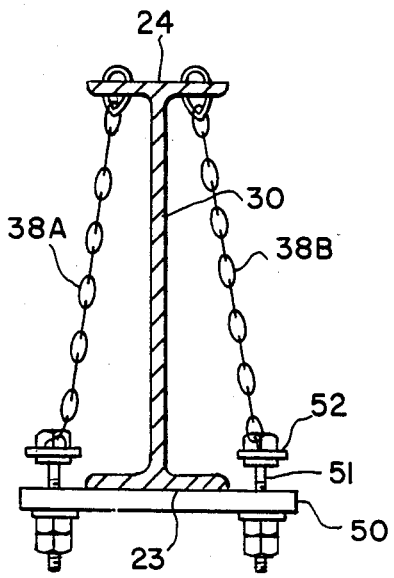

Thus it has been recognized that a passageway throughout the length of I-beam 15 is accessible on each side of and alongside the center web member 30 of the I-beam, as seen better from FIGS. 2 to 4. For obtaining such access, it is only necessary to remove or destroy small areas of the outside trim or finish at points 33 and 34 adjacent the beam ends 16 and 17. With such limited access, a load increasing member may then be passed along the length of the I-beam 15 on either side of the web plate member 30 between the lower and upper flanges 23 and 24.

As may be seen from FIG. 2, this load increasing member may be a flexible tension bearing member, preferably the chain 38. This cahin 38 may be simply hooked over the upper flange 24 at each end by means of the respective hooks 39 and 40. Since the force 26 is effective at the I-beam mid-point, the load may be shared by the chain 38 as a load increasing member by coupling the mid-point to the chain 38 under tension. Thus access is required only at the further single load bearing position on the lower flange intermediate the beam ends for effectively increasing the load bearing capacity of the beam, as shown at 42 in FIG. 1. This again requires a minimal amount of destruction of existing decor to obtain access and strengthen the I-beam.

By the structure shown in FIGS. 2 to 4, all welding is avoided, and a simple adjustable coupling system provides not only means to apportion the shared amount of the load to the strengthening chain 38, but also means to balance the loads shared by the respective chains 38A and 38B on opposite sides of the web plate 30 of the I-beam.

The coupling system provides a load bearing plate member 50, extending from opposide sides of the lower flange 23, and positioned adjacent the flange in load bearing relationship. with the flange. This is coupled by a simple bolt-nut adjustable coupling member 51 to a saddle member 52 lieing over the chain 38 to exert downwardly applied tension as the bolt-nut coupler 51 is tightened. This requires no weakening of the I-beam by drilling or welding, and adds to the load sharing capacity of the beam that portion of the load capacity shared by the strength of the chain, or equivalent flexible cable member. Typically the flexible chain 38 is made taut and put into tension with a light load, so that any further load is fully shared by the chain when the beam begins to flex under load.

Typically, for existing W18×35 I-beams, a $\frac{3}{4}$ inch alloy steel chain with a work load of 23,000 pound minutes on both sides of the beam may be used. The hooks are $\frac{3}{4}$ inch narrow throat heavy duty drop forged alloy steel hooks. The adjustment bolt is a $\frac{5}{8}$ inch bolt.

Figure 5:
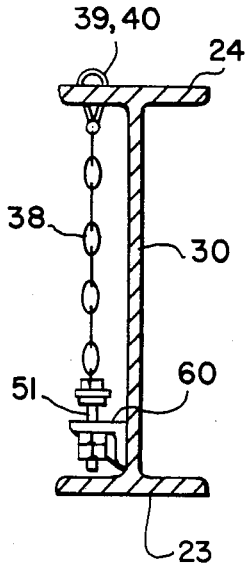
FIGS. 5 and 6 show respective end and detailed end views partly broken away of a further embodiment of the invention.
Figure 6:
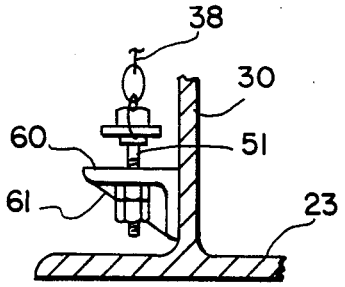

For installation on one side only of the web plate of the I-beam, reference is made to FIGS. 5 and 6. The chain and hook is preferably of greater load bearing capacity, such as a 7/8 inch chain and hook. In this case the bracket 60 having gussets 61 on each side of the bolt 51 is welded to the web plate 30 of the I-beam at a position near the lower flange. The weld is at a position of easy access and not adjacent surrounding building structure so that there is little fire danger from the weld.

The same method of reworking building structures to increase load bearing capacity can be used for example with wooden beam girders, if there is access alongside the beam between two spaced positions, such as the beam ends, opposite an intermediate load bearing position.

In essence a novel post tensioning system is provided by this invention for increasing the load bearing capacity of insitu beam girders embedded in a building, without requiring significant destruction and rework. Thus, the chain is post tensioned after installation to that degree desired to bear the increased load. The increase of load bearing capacity may thus be precisely predetermined by the load bearing capacity of the chain and its tension thereby to share with the beam its load to permit an increase in its load bearing capacity.

In building structures with embedded beams, they are in most cases inaccessible for most of their length by interference of piping, wiring and other structural bodies, so that a method that required more than the minimal access to the beam afforded by this invention would not permit a simple increase of load bearing capacity, without considerable destruction of the building, walls and other structural members.

This invention has the improved the building loading arts and beam girder loading methods and structure, and thus those novel features descriptive of the spirit of the invention are described with particularity in the claims.

I claim:

1. The method of reworking a structure for increasing the load bearing capacity of an I-beam built thereinto and covered by parts of the structure, the I-beam having a web member from which extends an upper flange in contact with a downwardly directed load and a lower flange supported at two ends to bear the load, which I-beam has an associated end to end cavity available along the web member between the flanges, the method comprising:

obtaining access to the two I-beam ends by removing parts of the structure covering the ends, obtaining access to the I-beam cavity and to at least one load bearing position on the lower flange intermediate the ends by removing parts of the structure covering that position, stringing a flexible, tension bearing longitudinal member through the cavity alongside at least one side of the I-beam web member from one end to the other of the I-beam, attaching ends of the longitudinal member in tension bearing capacity to the upper flange portion of the I-beam at each end thereof, connecting an intermediate portion of the attached longitudinal member with the I-beam lower flange at the load bearing position, and placing the longitudinal member in tension between the I-beam ends and the intermediate lower flange position, thereby sharing and supplementing the load bearing capacity of the I-beam.

2. The method defined in claim 1, wherein a separate longitudinal member is passed along opposite sides of the web member, each such longitudinal member is attached at the ends of the beam and a load bearing plate in load bearing contact with the beam below the lower flange is affixed to both the longitudinal members to share the load born by the beam.

3. The method defined in claim 1 wherein the longitudinal member is a chain having end hooks thereon hooked over an upper flange at each end of the I-beam.

4. The method defined in claim 1 including the step of adjusting the tension in the longitudinal member at the lower flange bearing position after affixing it to the lower flange by means of an adjustable screw coupling the member to the flange.

5. The method of strengthing I-beam girders having a web member with upper and lower flanges extending therefrom between two ends, comprising the steps of, stringing a flexible, manually bendable tension bearing longitudinal member alongside the web member from one end of the beam to an opposite end of the beam, attaching the tension member to the beam at both ends of the beam near the upper flange, and connecting an intermediate portion of the tension member with the lower flange of the beam at only one intermediate point along the beam in a load bearing tension relationship between the ends of the beam and the intermediate point to share a beam load that bears on the upper flange.

6. The method of claim 5 including the step of adjusting the load bearing capacity by adjusting the tension in the longitudinal member by means of an adjustable member connected between it and the lower flange at the intermediate point location.

7. The method of claim 5, wherein the I-beam is a load bearing member of a structure before stringing the longitudinal member, in which structure the beam is embedded with limited access thereto, and the structure is being reworked to increase the load bearing capacity of the I-beam before attaching the longitudinal member, comprising the additional steps of: obtaining access to the two ends of the beam and a region about the lower flange at which the longitudinal member is attached by destruction of the structure in which the beam is embedded only at the three points, thereby limiting the region of destruction in obtaining accesss to the I-beam required in increasing the I-beam load and the modification of structure in which the I-beam is embedded.

8. The method of claim 5 including the expanded steps of stringing a longitudinal member on both sides of the web member and attaching them respectively near the upper flanges on either side of the web member, and abutting the lower flange in said load bearing position with a load bearing plate member extending on opposite sides of the lower flange and in load bearing contact upwardly against the flange, wherein the two longitudinal members are attached to the load bearing plate on the respective sides of the flange.

9. A strengthened I-beam girder forming part of a previously-built structure in which the girder was originally installed, and having an increased load carrying capacity as compared with the same girder as it was originally installed in the structure, comprising in combination, an I-beam including a web member having upper and lower flanges extending therefrom between two ends of the beam, said web member being a continuous, uninterrupted web member free of openings, a flexible, tension bearing longitudinal member that is manually bendable to permit threading and manipulation of the longitudinal member through a passageway defined by a space between the beam and adjacent trim and finish portions of a building structure and around building elements positioned in the space to permit the longitudinal members to be attached to the beam after the beam has been enclosed by trim and finish portions of a building structure, the longitudinal member positioned alongside the web member from end to end and attached to and extending between both ends of the beam near the upper flange, the longitudinal member connected at a single intermediate position with the lower flange and being in a load bearing tension relationship between the intermediate position and the ends, and tensioning means carried at the intermediate position for tensioning the longitudinal member to share a beam load bearing on the upper flange of the beam, said tensioning means being adjustable to carry the tension in the flexible member between the intermediate position and the ends.

10. A girder as defined in claim 9 having said longitudinal member attached at an intermediate flange position on both sides of the web member to the lower flange by the tensioning means.

11. A girder as defined in claim 10 having a load bearing plate member in load bearing contact with the lower flange at the intermediate position and extending laterally outwardly therebeyond with the respective longitudinal members attached to opposite lateral ends of the plate member, said tensioning means connecting the respective flexible members to the plate member.

12. A girder as defined in claim 9 including hook means carried at each end of the flexible longitudinal member for attaching ends of the longitudinal member to ends of the upper flange of the beam without modification of the ends of the beam.

13. The method of conditioning a beam girder to increase its load bearing capacity, the beam girder enclosed in-situ in a building structure, comprising the steps of: obtaining access to the beam at only three positions along its length and through the structure in which the beam is enclosed, namely an intermediate load bearing position and two outer positions spaced on opposite sides of the intermediate load bearing position, passing a flexible, tension bearing longitudinal member alongside the beam between the two outer positions, connecting the longitudinal member with the beam at the three positions in a tension relationship to share with the beam a portion of its load, and adjusting the tension in the longitudinal member and thus its load share to a predetermined tension value.

14. The method of reworking a previously built structure having embedded therein a beam to increase the beam load bearing capacity, comprising in combination the steps of:

obtaining access to the beam at three longitudinally spaced positions, namely an intermediate load bearing position and two outer positions on opposite sides of the load bearing position by local destruction of the structure embedding the beam at only the three positions, stringing a flexible, tension bearing longitudinal member alongside the beam between said spaced positions, and connecting the flexible member with the beam at the intermediate load bearing position and at least one of the structure adjacent each of the two outer positions and the beam at each of the two outer positions, and placing the flexible member under tension for sharing and increasing the load bearing capacity of the beam.

15. The method of claim 14 including the step of post tensioning at the intermediate load bearing position the tension in said longitudinal member to provide a predetermined load bearing share of the beam load borne by the longitudinal member.

16. The method of increasing the load bearing capacity of an embedded beam girder in a previously built structure, the method comprising: reworking the structure to gain access to only three longitudinally spaced positions along the length of the beam, positioning a flexible member longitudinally alongside the beam between the three spaced positions, connecting the member with the beam at said three positions along its length, namely at two upper positions near the ends of the beam and at one lower position intermediate the ends of the beam, and tensioning the flexible member to share a predetermined portion of the beam load.

17. A reworked structure resulting from the method of claim 16.

* * * * *